US007256806B2

(12) United States Patent
Nakatani

(10) Patent No.: US 7,256,806 B2
(45) Date of Patent: Aug. 14, 2007

(54) IMAGE FORMATION APPARATUS AND SUBLIMATION PRINTER

(75) Inventor: Masaki Nakatani, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 264 days.

(21) Appl. No.: 11/111,705

(22) Filed: Apr. 22, 2005

(65) Prior Publication Data

US 2005/0243157 A1 Nov. 3, 2005

(30) Foreign Application Priority Data

Apr. 28, 2004 (JP) ..... 2004-132721

(51) Int. Cl.
*B41J 2/32* (2006.01)

(52) U.S. Cl. ..... 347/197

(58) Field of Classification Search ..... 347/197, 347/222, 223, 220, 219, 218; 400/120.16
See application file for complete search history.

(56) References Cited

U.S. PATENT DOCUMENTS

2004/0085434 A1* 5/2004 Hayashi ..... 347/218
2005/0212898 A1* 9/2005 Lee ..... 347/222

FOREIGN PATENT DOCUMENTS

JP 09-071022 A1 3/1997
JP 3093548 U 5/2003

* cited by examiner

*Primary Examiner*—K. Feggins
(74) *Attorney, Agent, or Firm*—Global IP Counselors, LLP

(57) ABSTRACT

An image formation apparatus or a sublimation printer includes a main frame, a platen roller, a head assembly, and an extension spring diagonally attached to the head assembly and the main frame so as to bias the head assembly in a direction away from the platen roller and in an axial direction of the platen roller. The head assembly has an arm portion and a head portion. The head assembly is pivotably held between side panels of the main frame so as to be pressed against and moved away from the platen roller. The extension spring keeps the thermal head away from the platen roller when printing is not performed, and also aligns the thermal head in the axial direction of the platen roller. The number of components of the sublimation printer can be reduced.

11 Claims, 3 Drawing Sheets

IMAGE FORMATION APPARATUS AND SUBLIMATION PRINTER

BACKGROUND OF THE INVENTION

1. Field of the Invention

The present invention generally relates to an image formation apparatus and a sublimation printer. More specifically, the present invention relates to an image formation apparatus and a sublimation printer which transfer ink from an ink ribbon onto paper by electrical heating of a thermal head.

2. Background Information

With a conventional sublimation printer, a platen roller is rotatably attached between side panels of a main frame, and a thermal head is disposed across from this platen roller. This thermal head is supported on a head assembly, which is pivotably attached to a plate provided on the inside of the side panels of the main frame. The pivoting of the head assembly causes the thermal head to move away from the platen roller. The printer is provided with a torsion spring for generating a biasing force that causes the head assembly to pivot so that the thermal head moves away from the platen roller, and a coil spring for generating a biasing force that presses the head assembly against one of the side panels of the main frame. The torsion spring is designed to keep the thermal head away from the platen roller when not printing, and the coil spring is designed to prevent the thermal head from becoming misaligned in the axial direction of the platen roller. Also provided are a press lever of which the pivoting causes the head assembly to pivot, thereby pressing the thermal head against the platen roller, and a drive component for pivoting this press lever.

With a sublimation printer, the printing of text or graphics is accomplished by laying an ink ribbon and paper one over the other, passing them between the thermal head and the platen roller, and applying heat to the thermal head during this passage so that the ink in the ink ribbon will be transferred to the paper. If there is any misalignment of the thermal head in the axial direction of the platen roller during this process, the printing of the text or graphics on the paper will also be misaligned. The above-mentioned coil spring is provided so that this will not happen.

Also, the above-mentioned torsion spring is provided in order to prevent the thermal head from pressing on the platen roller when no printing is in progress, such that deformation of the platen roller and shortening the service life of the thermal head can be prevented.

It has been proposed in Japanese Patent Application Publication 9-71022 to attach a spring diagonally between a head press bar and a thermal head, so that the biasing force of this spring will prevent the misalignment of the thermal head in the axial direction of the platen roller during printing. Also, the thermal head will press on the platen roller with uniform pressure. This head press bar corresponds to the portion that supports the thermal head in the above-mentioned head assembly.

However, with a conventional sublimation printer, as discussed above, the torsion spring for keeping the thermal head away from the platen roller while the printing is not in progress, and the coil spring for preventing the misalignment of the thermal head in the axial direction of the platen roller are separately required. Thus, such conventional sublimation printer requires many parts, which is a problem in that the component cost is higher. Also, because of the greater number of parts, its assembly entails more labor. As a result, assembly costs incurred in the assembly of such conventional sublimation printer also end up being high.

Japanese Patent Application Publication 9-71022 proposes to generate a biasing force for preventing the misalignment of the thermal head in the axial direction of the platen roller, and a biasing force for maintaining uniform pressure of the thermal head on the platen roller, with a single spring. However, Japanese Patent Application Publication 9-71022 does not disclose or suggest a single elastic member that generates biasing force for keeping the thermal head away from the platen roller as well as the biasing force for preventing the misalignment of the thermal head in the axial direction of the platen roller.

In view of the above, it will be apparent to those skilled in the art from this disclosure that there exists a need for an improved image formation apparatus and a sublimation printer that overcome the problems of the conventional art. This invention addresses this need in the art as well as other needs, which will become apparent to those skilled in the art from this disclosure.

SUMMARY OF THE INVENTION

It is an object of the present invention to provide an image formation apparatus and a sublimation printer that requires fewer components and allows a reduction in the manufacturing cost by generating a biasing force for keeping the thermal head away from the platen roller when printing is not in progress and a biasing force for preventing misalignment of the thermal head in the axial direction of the platen roller, with a single elastic member.

The image formation apparatus in accordance with the first aspect of the present invention includes a main frame having side panels; a platen roller rotatably held between the side panels of the main frame; a head assembly having an arm portion and a head portion; and an elastic member diagonally attached to the head assembly and the main frame. The head assembly is pivotably held between the side panels of the main frame so as to be pressed against and moved away from the platen roller. The elastic member biases the head assembly in a direction away from the platen roller and in an axial direction of the platen roller.

With this constitution, the elastic member that links the head assembly and the main frame is attached diagonally so as to generate a biasing force that biases the head assembly in two directions: the axial direction of the platen roller and the direction in which the thermal head is moved away from the platen roller. Therefore, a biasing force for keeping the thermal head away from the platen roller while the printing is not performed and a biasing force for preventing the misalignment of the thermal head in the axial direction of the platen roller can be generated with a single elastic member. Accordingly, the number of components required in the image formation apparatus can be reduced. As a result, the component cost and the assembly cost can be reduced, making the image formation apparatus less expensive to manufacture.

The image formation apparatus in accordance with the second aspect of the present invention is the image formation apparatus of the first aspect of the present invention, in which the main frame has a hook portion formed on one of the side panels, in which one end of the elastic member is attached.

The image formation apparatus in accordance with the third aspect of the present invention is the image formation apparatus of the first aspect of the present invention, in which the head assembly has a hook portion formed on the arm portion, in which one end of the elastic member is attached.

The image formation apparatus in accordance with the fourth aspect of the present invention is the image formation apparatus of the first aspect of the present invention, in which the main frame further includes a plate portion, and the head assembly has a boss portion formed in the arm portion that is rotatably attached to the plate portion.

The image formation apparatus in accordance with the fifth aspect of the present invention is the image formation apparatus of the first aspect of the present invention, in which the head portion is a thermal header.

The image formation apparatus in accordance with the sixth aspect of the present invention is the image formation apparatus of the first aspect of the present invention, in which the elastic member is an extension spring.

The image formation apparatus in accordance with the seventh aspect of the present invention is the image formation apparatus of the first aspect of the present invention, further including a pressing mechanism that moves the head assembly toward the platen roller such that the head portion presses against the platen roller.

The image formation apparatus in accordance with the eighth aspect of the present invention is the image formation apparatus of the first aspect of the present invention, in which the image formation apparatus is a sublimation printer.

A sublimation printer in accordance with the ninth aspect of the present invention includes a main frame having side panels; a thermal head; a platen roller rotatably held between the side panels of the main frame; holding means for holding the thermal head so as to be pivotable between the side panels of the main frame such that the thermal head is pressed against and moved away from the platen roller; and biasing means for biasing the thermal head so as to move the thermal head away from the platen roller and to align the thermal head with the platen roller in an axial direction of the platen roller.

The sublimation printer in accordance with the tenth aspect of the present invention is the sublimation printer in accordance with the ninth aspect of the present invention, in which the biasing member pulls the thermal head in a direction away from the platen roller and in the axial direction of the platen roller.

The sublimation printer in accordance with the eleventh aspect of the present invention is the sublimation printer in accordance with the ninth aspect of the present invention, further including pressing means for pressing the thermal head against the platen roller.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

An embodiment of the sublimation printer of the present invention will now be described.

Figure 1:
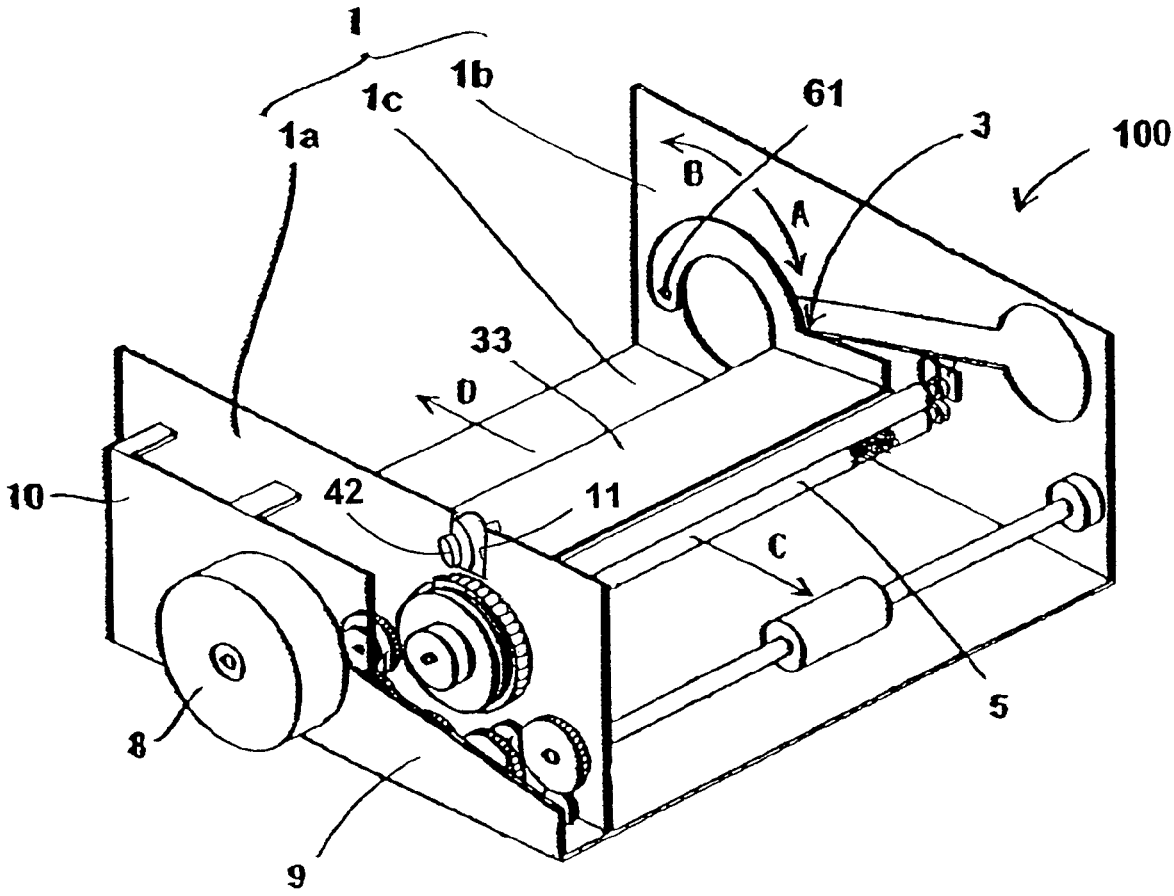
FIG. 1 is a perspective view of the printing component of a sublimation printer in accordance with an embodiment of the present invention.
Figure 2:
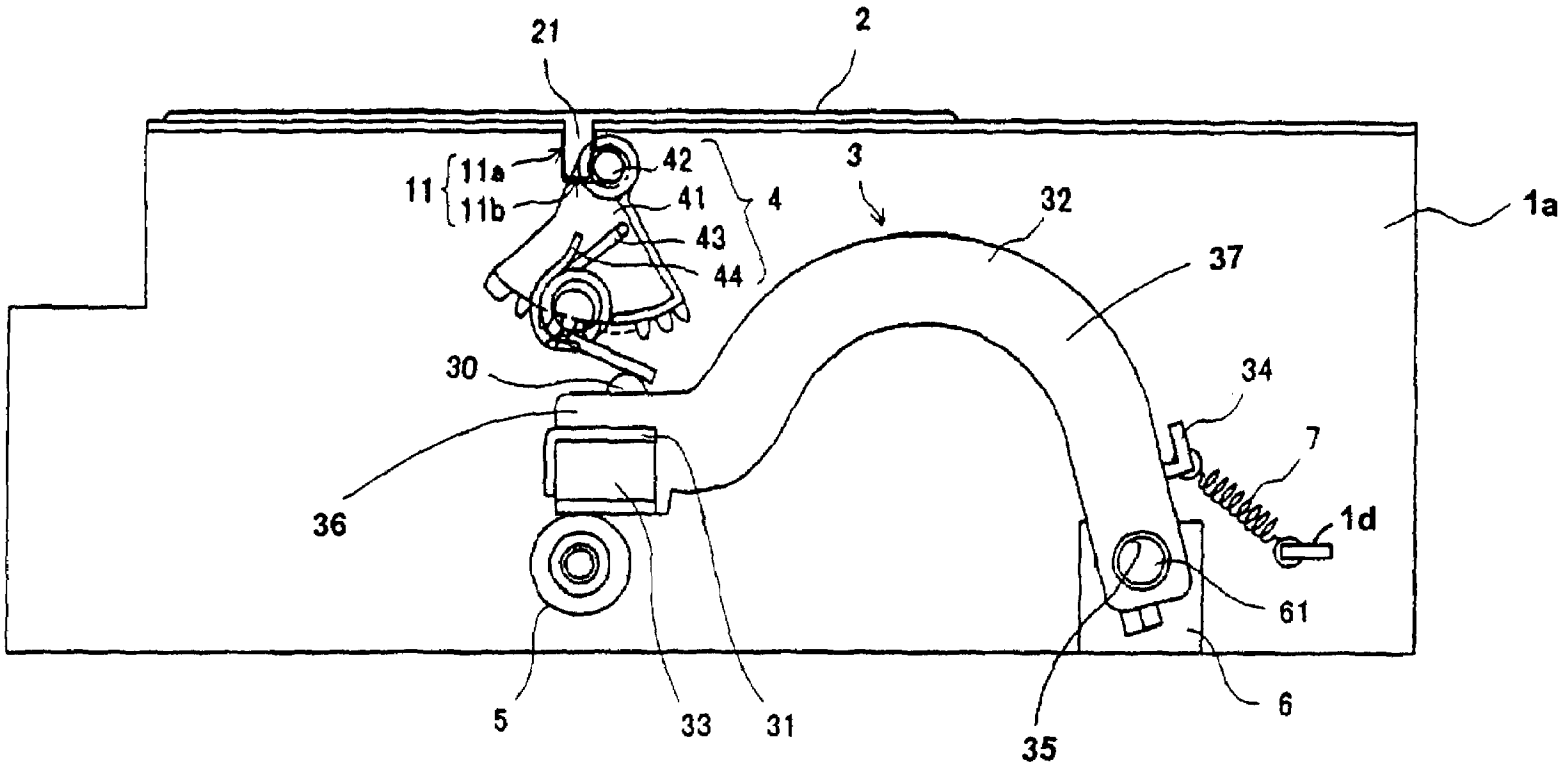
FIG. 2 is a schematic diagram illustrating the structure in the vicinity of the printing component of a sublimation printer in accordance with the embodiment of the present invention.

FIG. 1 is a perspective view of a dye sublimation printer 100 in accordance with an embodiment of the present invention. FIG. 2 is a simplified diagram illustrating the structure in the vicinity of the printing component of a sublimation printer 100 according to an embodiment of the present invention. The sublimation printer 100 in this embodiment includes a main frame 1 having side panels 1*a* and 1*b* and a gear case 10 that are connected with a bottom panel 1*c*; a platen roller 5 rotatably held between the side panels 1*a* and 1*b* of the main frame 1; a head assembly 3 pivotably held between the side plates 1*a* and 1*b* and supporting a thermal head 33 located across from the platen roller 5; a press lever 4 (an example of the pressing mechanism and the pressing means) that pivots the head assembly 3 and presses the thermal head 33 against the platen roller 5; a lid 2 disposed on the top side of the side panels 1*a* and 1*b*; a motor 8; and a gear assembly 9 (omitted in FIG. 2). In FIG. 2, the left-right direction is the paper conveyance direction, and the direction of the rotational axis of the platen roller 5 is perpendicular to the paper plane of FIG. 2. The head assembly 3 is pivotably attached to a plate 6, which is provided to the bottom panel 1*c* of the main frame 1.

The head assembly 3 includes the thermal head 33, a head support 31 for supporting the thermal head 33 from the top and side, and a head pressing arm 32 (an example of the holding means) for supporting the head support 31. The thermal head 33 is substantially cuboid in shape, and its lengthwise direction is perpendicular to the paper conveyance direction. In other words, the thermal head 33 extends in a direction perpendicular to the paper plane of FIG. 2.

The head support 31 includes portions that come into contact with the top and side of the thermal head 33. This head support 31 is connected to the head pressing arm 32. The head pressing arm 32 includes a connecting component that connects to the head support 31, and a pair of arm components that extend perpendicular to the axial direction of the thermal head 33. In other words, the arm components 37 of the head pressing arm 32 extend in the paper conveyance direction. The connecting component 36 and the arm components 37 of the head pressing arm 32 are formed integrally as a unitary member. A boss 30 that is semicircular in cross section and protrudes upward is provided to the top of the head pressing arm 32 at a point close to the conveyance direction end of the head support 31. The end of the head pressing arm 32 that is not connected to the head support 31 is pivotably attached to the plate 6, which is provided to the bottom panel 1*c* of the main frame 1.

Figure 3:
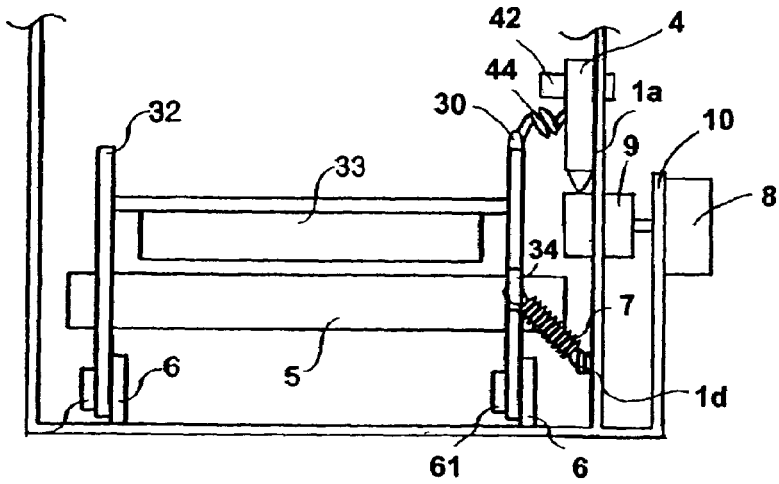
FIG. 3 is a diagram illustrating the attachment structure of the head assembly in the sublimation printer in accordance with the embodiment of the present invention.

This plate 6 is provided on both sides of the main frame as shown in FIG. 3. Each of the plates 6 has a boss 61 formed on one side. The head assembly 3 is pivotably supported by the main frame by fitting these bosses 61 into circular openings 35 made in the arm components 37. In other words, the head assembly 3 is pivotably attached to the main frame by a simple operation involving merely fitting these bosses 61 into the circular openings 35 made in the arm components 37of the head pressing arm 32. Therefore, the labor required in the assembly, in which the head assembly 3 is pivotably attached to the main frame, can be reduced, and the cost of assembling the apparatus can be reduced.

Also, a hook 34 is formed on one of the arm components 37 near the circular opening 35 that is attached to the plate 6, such that one end of an extension spring 7 (an example of the elastic member) is hooked onto this hook 34. The other end of the extension spring 7 is hooked onto a hook 1*d* formed on the side panel 1*a* of the main frame 1. As shown in FIG. 3, the extension spring 7 is attached diagonally to the paper conveyance direction. This extension spring 7 exerts a biasing force on the head assembly 3 in two directions: the direction in which the thermal head 33 is moved away from the platen roller 5 (upward direction as viewed in FIG. 2 or in the direction of B shown in FIG. 1), and the direction of the rotational axis of the platen roller 5 (the direction perpendicular to the plane of the drawing in FIG. 2 and rightward direction as viewed in FIG. 3).

Figure 4:
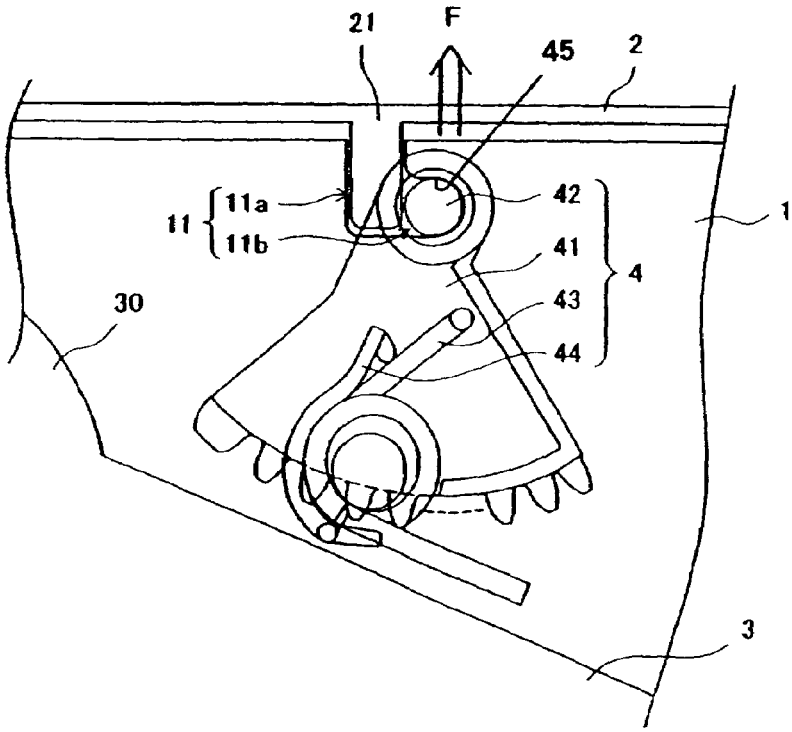
FIG. 4 is a diagram illustrating the structure of the press lever in the sublimation printer in accordance with the embodiment of the present invention.

FIG. 4 is a diagram of the structure of the press lever 4. The press lever 4 includes a fan plate 41, a rotary shaft 42, and a torsion spring 43. The fan plate 41 is substantially fan-shaped and has at its apex a through-hole 45 in which a rotary shaft 42 is fitted. The rotary shaft 42 is also rotatably fitted into a groove 11 formed in the side panel 1*a*. The torsion spring 43 is coupled near an arc-shaped surface of the fan plate 41 via a fixing member 44 with one end of the torsion spring 43 protruding beyond the arc-shaped surface of the fan plate 41. A plurality of teeth is formed on the arc-shaped surface of the fan plate 41, such that the plurality of teeth engages a motor via an external gear (not shown).

In the side panel 1*a* of the main frame 1, an L-shaped groove 11 having a first groove portion 11*a* and a second groove portion 11*b* is formed. The first groove portion 11*a* has an opening at the top of the side panel 1*a*. The second groove portion 11*b* communicates with the first groove portion 11*a* and extends in a direction perpendicular to the direction in which the first groove portion 11*a* extends. The rotary shaft 42 of the press lever 4 is fitted into the end of this second groove portion 11*b*.

On the lid 2 of the main frame is formed a protrusion 21 that bends toward the side panel 1*a* and is located at a position that corresponds to the portion of the side panel 1*a* where the first groove portion 11*a* of the groove 11 is formed. This protrusion 21 is formed in a shape that matches with the contour of the first groove portion 11*a* of the groove 11 when the lid 2 is placed on top of the side panel 1*a*, such that the protrusion 21 fits into the first groove portion 11*a*.

When the motor 8 is rotated, the gear 9 connected to the rotary shaft of the motor rotates, and the rotation of this gear causes the press lever 4 to pivot around the rotary shaft 42. The torsion spring 43 pivots together with the press lever 4, and one end of the torsion spring 43 strikes the boss 30 formed on the head pressing arm 32. When the press lever 4 is pivoted further, the end of the torsion spring 43 descends further and pushes the boss 30 diagonally downward. The pressure applied by the torsion spring 43 pivots the head assembly 3, pressing the thermal head 33 against the platen roller 5.

In this state, the press lever 4 is subjected to a reaction force F of the force that presses the thermal head 33 against the platen roller 5. As shown in FIG. 4, this reaction force F causes the rotary shaft 42 of the press lever 4 to be pushed upward. Since the top of the rotary shaft 42 is hitting the side wall of the second groove portion 11*b* of the groove 11 formed in the side panel la, this reaction force F does not cause the rotary shaft 42 to move out of the groove 11.

The sublimation printer 100 is constituted such that the torsion spring 43 presses on the head assembly 3 during printing, but the torsion spring 43 does not press on the head assembly 3 when no printing is being performed. As discussed above, the extension spring 7 exerts a biasing force on the head assembly 3 in two directions: the direction in which the thermal head 33 is moved away from the platen roller 5, and the rotational axis direction of the platen roller 5. In other words, since the extension spring 7 pulls the head assembly 3 toward the right hand side as viewed in FIG. 3, the misalignment of the thermal head 33 in the axial direction of the platen roller 5 is less likely to occur during printing. Also, since the extension spring 7 pulls the head assembly 3 in the direction in which the thermal head 33 is moved away from the platen roller 5, the thermal head 33 is kept from pressing on the platen roller 5 while no printing is being performed.

Thus, the single extension spring 7 exerts a biasing force for keeping the thermal head 33 away from the platen roller 5 while no printing is being performed as well as for preventing the misalignment of the thermal head 33 in the axial direction of the platen roller 5. Therefore, the number of components required in the sublimation printer 100 can be reduced. Thus, the component cost can be held down, making the sublimation printer 100 less expensive to manufacture. Also, the ends of the extension spring 7 are merely hooked over the hook 34 formed on the head assembly 3 and the hook 1*d* formed on the main frame 1. Thus, less labor is required in attaching the extension spring 7, which allows the manufacturing cost of the sublimation printer 100 to be kept low.

Next, the printing operation with the sublimation printer 100 of this embodiment will be described. The sublimation printer 100 in accordance with t his embodiment is a printer that prints color images. An ink ribbon is flanked on both sides by the thermal head 33, and is played out from the paper feed side and wound in on the paper discharge side. The ink ribbon has cyan, magenta, and yellow ink ribbons connected to one another in that order. The length of the ink ribbon of each color is the same as the conveyance direction length of the paper on which the color images are to be printed.

When the color images to be printed are inputted, the sublimation printer 100 subjects the inputted color images to color separation, producing cyan images, magenta images, and yellow images. The sublimation printer 100 feeds in paper from a paper feeder (not shown), and the front end of the cyan ink ribbon is aligned with the front end of the paper in front of the thermal head 33 and fed in this state between the platen roller 5 and the thermal head 33. Once the front end of the paper reaches the printing position of the thermal head 33, the press lever 4 is pivoted so that the torsion spring 43 presses down on the boss 30 of the head assembly 3. This causes the thermal head 33 to press against the platen roller 5 with sufficient pressing force. The ink ribbon and paper are conveyed with one pressed against the other between the platen roller 5 and the thermal head 33. At this time, the paper is conveyed by a conveyor roller (not shown), while the ink ribbon is wound in on the paper discharge side. Once the rear end of the paper reaches the printing position of the thermal head 33, the feeding of the paper and the winding of the ink ribbon are halted. Then, the press lever 4 is pivoted so that the torsion spring 43 is no longer touching the boss 30 formed on the head assembly 3. This completes the printing of a cyan image, at which point the printing of a magenta image over this cyan image is commenced.

In this state, only the paper is conveyed back to the paper feed side. The front end of the paper and the front end of the magenta ink ribbon are aligned together and fed in this state between the platen roller 5 and the thermal head 33. Once the front end of the paper reaches the printing position of the thermal head 33, the press lever 4 is pivoted so that the torsion spring 43 presses down on the boss 30 of the head assembly 3. This causes the thermal head 33 to press against the platen roller 5 with sufficient pressing force. The ink ribbon and paper are conveyed with one pressed against the other between the platen roller 5 and the thermal head 33. At this time, the paper is conveyed by a conveyor roller (not shown), while the ink ribbon is wound in on the paper discharge side. Once the rear end of the paper reaches the printing position of the thermal head 33, the feeding of the paper and the winding of the ink ribbon are halted, and the press lever 4 is pivoted so that the torsion spring 43 is no longer touching the boss 30 formed on the head assembly 3. This completes the printing of a magenta image, at which point the printing of a yellow image over this magenta image is commenced.

As in the above step of printing magenta images, only the paper is conveyed back to the paper feed side. The front end of the paper and the front end of the yellow ink ribbon are aligned together and fed in this state between the platen roller 5 and the thermal head 33. Once the front end of the paper reaches the printing position of the thermal head 33, the press lever 4 is pivoted so that the torsion spring 43 presses down on the boss 30 of the head assembly 3. This causes the thermal head 33 to press against the platen roller 5 with sufficient pressing force. The ink ribbon and paper are conveyed with one pressed against the other between the platen roller 5 and the thermal head 33. At this time, the paper is conveyed by a conveyor roller (not shown), while the ink ribbon is wound in on the paper discharge side. Once the rear end of the paper reaches the printing position of the thermal head 33, the feeding of the paper and the winding of the ink ribbon are halted, and the press lever 4 is pivoted so that the torsion spring 43 is no longer touching the boss 30 formed on the head assembly 3. This completes the printing of a yellow image, and also completes the printing of a color image.

With a sublimation printer constituted as above, the rotary shaft 42 of the press lever 4 is supported by the second groove portion 11*b* of the groove 11 in the side panel 1*a*, which prevents the rotary shaft 42 from being moved out of the groove 11 by the reaction force generated by the force of the head assembly 3 pressing against the platen roller 5.

Furthermore, the groove 11 has the second groove portion 11*b* that is not open upward at a position a specific distance away from the top of the side panel 1*a*. Thus, the groove 11 is very strong against an upward force, and does not deform even after being repeatedly subjected to the above-mentioned reaction force. Therefore, the position of the rotary shaft 42 is not affected by the repeated thrust of the reaction force F encountered during the printing operation. As a result, the sublimation printer 100 allows the thermal head 33 of the head assembly 3 to remain securely pressed against the platen roller 5 at the specified pressing force.

Also, since the head assembly 3 is pulled toward the right hand side as viewed in FIG. 3 by the extension spring 7, the misalignment of the thermal head 33 in the axial direction of the platen roller 5 is less likely to occur. Therefore, there is less misalignment of the printing positions of cyan, magenta, and yellow images on the paper, enabling print color images with reduced color drift.

Also, the groove 11 is formed in an L-shape, with the first groove portion 11*a* having an opening at the top of the side panel, and the second groove portion 11*b* that has upper and lower sides perpendicular to the first groove portion 11*a*. Thus, the press lever 4 can be fitted into the second groove portion 11*b* through the first groove portion 11*a* when being installed on the side panel 1 of the main frame. In other words, the press lever 4 can be installed very easily.

Also, the protrusion 21 of the lid 2 is fitted into the first groove portion 11*a* of the groove 11 and strikes or approaches the rotary shaft 42 horizontally, so that the rotary shaft 42 is supported from all four sides and its position is fixedly secured two-dimensionally. As a result, even though the pivoting of the press lever 4 changes the direction in which the reaction force is exerted and generates a force in the direction along the second groove portion 11*b*, this reaction force is borne by the side walls of the protrusion 21, preventing movement of the rotary shaft 42 in the direction in which the second groove portion 11*b* extends (the horizontal direction), and securing the rotary shaft 42 in the position more effectively.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

With the present invention, a biasing force for keeping the thermal head away from the platen roller when printing is not in progress and for preventing the misalignment of the thermal head with respect to the axial direction of the platen roller can be generated with a single elastic member, which reduces the number of components required for the apparatus. This holds down the component cost and the assembly cost, making the apparatus less expensive to produce.

Also, assembly is accomplished merely by hooking the ends of the elastic member onto the head assembly and the main frame, which further reduces the labor entailed by assembly and further lowers the cost of producing the apparatus.

Further, the head assembly can be pivotably attached to the plate in a very simple manner, which further reduces the labor entailed by assembly and further lowers the cost of producing the apparatus.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least±5% of the modified term if this deviation would not negate the meaning of the word it modifies.

This application claims priority to Japanese Patent Application No. 2004-132721.The entire disclosure of Japanese Patent Application No. 2004-132721 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An image formation apparatus, comprising:

a main frame having side panels;

a platen roller rotatably held between the side panels of the main frame;

a head assembly having an arm portion and a head portion, the head assembly being pivotably held between the side panels of the main frame so as to be pressed against and moved away from the platen roller; and an elastic member diagonally attached to the head assembly and the main frame so as to bias the head assembly in a direction away from the platen roller and in an axial direction of the platen roller.

2. The image formation apparatus according to claim 1, wherein the main frame has a hook portion formed on one of the side panels, in which one end of the elastic member is attached.

3. The image formation apparatus according to claim 1, wherein the head assembly has a hook portion formed on the arm portion, in which one end of the elastic member is attached.

4. The image formation apparatus according to claim 1, wherein the main frame further includes a plate portion, and the head assembly has a boss portion formed in the arm portion that is rotatably attached to the plate portion.

5. The image formation apparatus according to claim 1, wherein the head portion is a thermal header.

6. The image formation apparatus according to claim 1, wherein the elastic member is an extension spring.

7. The image formation apparatus according to claim 1, further comprising a pressing mechanism that moves the head assembly toward the platen roller such that the head portion presses against the platen roller.

8. The image formation apparatus according to claim 1, wherein the image formation apparatus is a sublimation printer.

9. A sublimation printer, comprising:

a main frame having side panels;

a thermal head;

a platen roller rotatably held between the side panels of the main frame;

holding means for holding the thermal head so as to be pivotable between the side panels of the main frame such that the thermal head is pressed against and moved away from the platen roller; and biasing means for biasing the thermal head so as to move the thermal head away from the platen roller and to align the thermal head with the platen roller in an axial direction of the platen roller.

10. The sublimation printer according to claim 9, wherein the biasing member pulls the thermal head in a direction away from the platen roller and in the axial direction of the platen roller.

11. The sublimation printer according to claim 9, further comprising pressing means for pressing the thermal head against the platen roller.

* * * * *